United States Patent [19]

Donovan

[11] Patent Number: 4,505,039

[45] Date of Patent: Mar. 19, 1985

[54] SEAMING TOOL FOR FLOOR COVERINGS

[76] Inventor: James P. Donovan, 4975 N. Ardmore St., Whitefish Bay, Wis. 53217

[21] Appl. No.: 520,017

[22] Filed: Aug. 3, 1983

[51] Int. Cl.[3] ..... B26D 7/20; B26D 7/16; B43L 7/00

[52] U.S. Cl. ..... 30/289; 81/3 R; 33/174 G; 269/87.2; 269/295

[58] Field of Search ..... 30/289, 286; 81/3 R; 33/174 G; 269/87.2, 295

[56] References Cited

U.S. PATENT DOCUMENTS 3,276,119 10/1966 Brucker ..... 30/289
3,985,129 10/1976 Huene ..... 30/289
4,429,461 2/1984 Glavic ..... 30/289

FOREIGN PATENT DOCUMENTS 3202335 8/1982 Fed. Rep. of Germany ..... 30/289

*Primary Examiner*—Roscoe V. Parker
*Attorney, Agent, or Firm*—Bayard H. Michael

[57] ABSTRACT

The seaming tool has elongated upper and lower plates hinged along their long edges to open like a book. The bottom of the lower plate has stops parallel to the hinge. The stops engage the edge of already laid floor covering and the to-be-laid material is positioned between the plates. The free edge of the upper plate now serves as the cutting guide. It is slightly closer to the hinge than the stop means to ensure a slight overlap of the materials to require a tight or force fit at the joint.

4 Claims, 3 Drawing Figures

SEAMING TOOL FOR FLOOR COVERINGS

FIELD OF THE INVENTION

A tool for improving the quality and reliability of seams in various floor coverings.

BACKGROUND OF THE INVENTION

Many types of floor coverings come in sheets of substantial width. Forming a proper joint between the abutting edges of the floor covering is difficult. If not done properly there will be gaps in the seam. In view of the expense of the floor covering material, there is great interest in ways to improve the reliability and quality of the job.

SUMMARY OF THE INVENTION

An object of this invention is to provide a seaming tool for use in conjunction with laying floor covering. The tool has elongated rectangular upper and lower plates each having a long edge connected to the other by means of a hinge so the plates can be opened and closed. Stop means fixed on the bottom of the lower plate position the hinge parallel to the free edge of the already laid material on which the bottom plate is positioned with the stop means engaging said free edge of the material. This positions the free long edge of the upper plate parallel to the hinge so the edge of material cut along the long edge of the upper plate will be parallel to the free edge of the laid material.

A further object is to provide such a seaming tool designed so the plates are substantially parallel when closed on material of the thickness for which the tool is designed.

Still another object is to provide such a seaming tool in which the free long edge of the upper plate is slightly closer to the hinge centerline than the stop means so the material between the plates which is cut along the edge of the upper plate will, when laid, slightly overlap the already laid material under the lower plate.

DETAILED DESCRIPTION OF THE DRAWINGS

Figure 1:
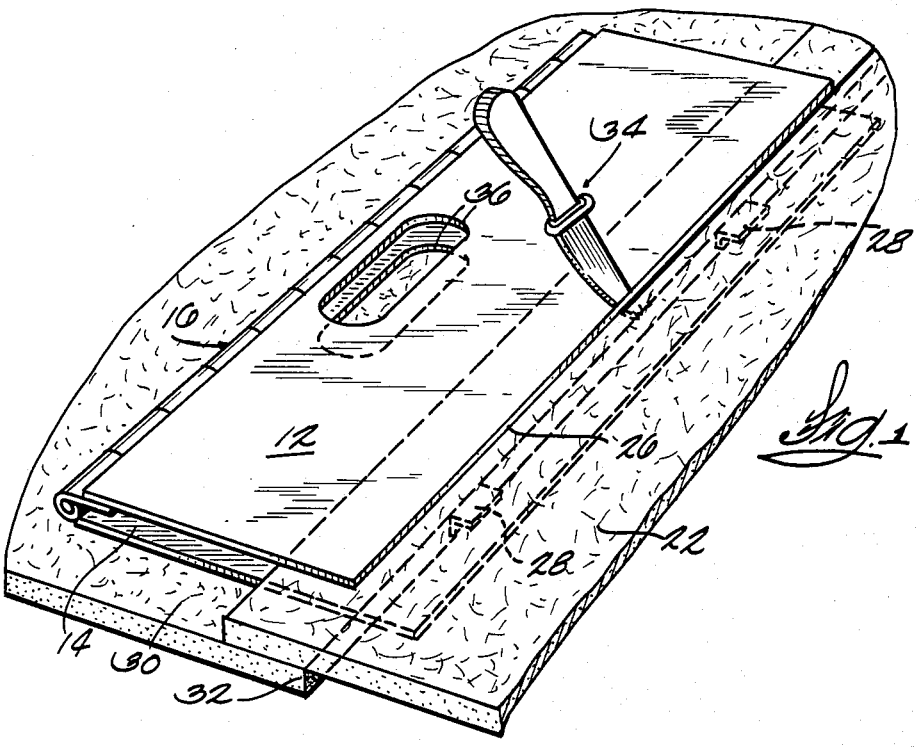
FIG. 1 is a perspective view showing the way the tool is used.
Figure 2:
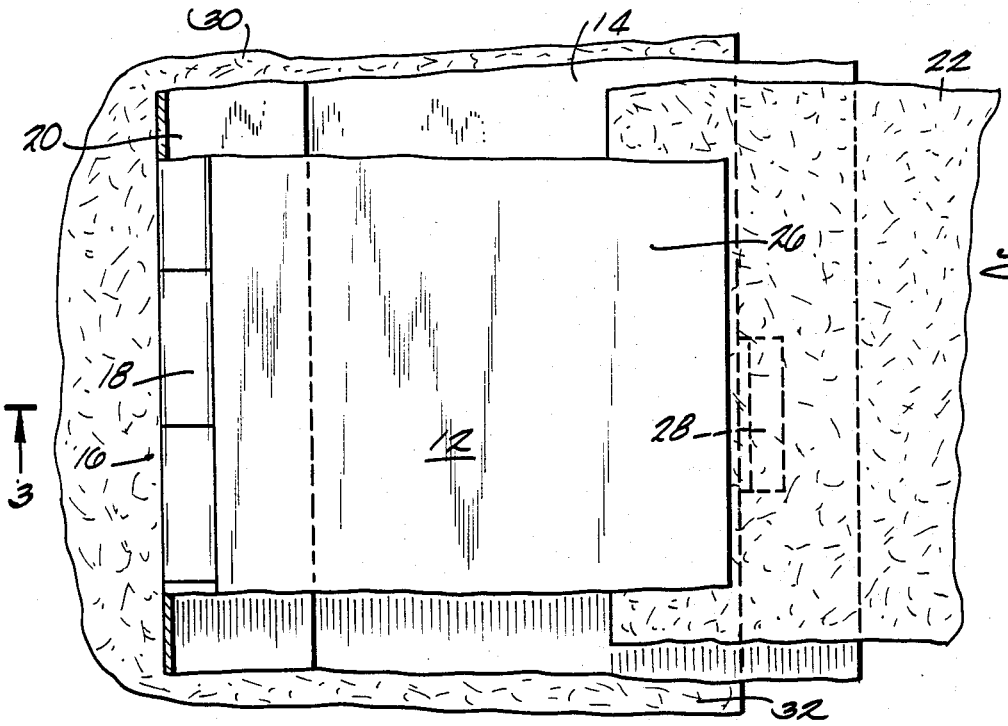
FIG. 2 is an enlarged plan view showing the relationship of the upper and lower plates and the floor covering materials to be joined.
Figure 3:
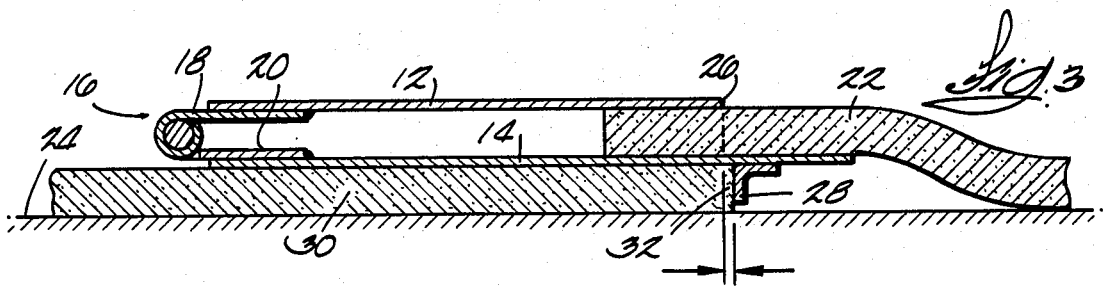
FIG. 3 is a vertical section on line 3—3 in FIG. 2.

The tool or cutting guide 10 has an elongated, rectangular upper plate 12 connected to elongated, rectangular lower plate 14 by means of piano hinge 16 running the length of the long sides of the plates. The tool is designed to be used with a specific thickness of floor covering material so the plates 12 and 14 will be substantially parallel when closed on the material as best seen in FIG. 3. Here the leaves 18, 20 of the hinge lie inside the plates 12, 14 so the plates are parallel when closed on the material 22. Somewhat thinner material (22) could be accommodated by placing one plate (12 or 14) inside one of the hinge leaves prior to welding the plates to the leaves. Or the plates can be formed to accommodate thicker material. Preferably only the upper plate will be formed so the lower plate will lie flat on the floor 24.

The upper plate 12 is welded to leaf 18 accurately so the free edge 26 is parallel to the hinge. Edge 26 is the cutting guide. Two stops 28 are welded to the bottom of the lower plate 14 parallel to the hinge and spaced far apart so as to simplify accurately positioning the lower plate relative to the material 30 already laid on the floor. When the stops are pushed up against the free edge of material 30, the hinge will be parallel to the edge.

Now the material 22 which is to be abutted to the piece 30 is laid on the upper surface of plate 14 to lie under plate 12 when plate 12 is closed onto material 22. Edge 26 is about 1/16" closer to the hinge than the face 32 of the stop 28. Therefore, when the knife 34 (or other cutting tool) is run along the edge 26 of the upper plate, the material 22 will have a 1/16" overlap on the lower material 30. This insures a tight fit when the tool is removed and the material 22 is laid on floor 24. Since the joint has to absorb the 1/16" overlap, the seam will be tight and practically invisible.

With this tool the quality of the finished job is greatly increased. Obviously the edge on the lower or already-laid piece 30 has to be straight for the joint or seam to be right. The edge on the material as it comes from the factory is quite good. If such an edge cannot be used for referencing this tool, then the worker must first provide a straight edge. This tool is preferably made of rather heavy steel to withstand rough handling and abuse. It is easily carried by the aligned hand grip holes 36 at the balance point near the hinge.

I claim:

1. A seaming tool for use in laying floor covering, comprising, elongated rectangular upper and lower plates each having a long edge connected to the other by means of a hinge so the plates can be opened and closed, stop means fixed on the bottom of the lower plate to position the hinge parallel to the free edge of the already laid material on which the bottom plate is positioned with the stop means engaging said free edge of the material, the free long edge of the upper plate being parallel to and spaced from the hinge so the edge of material cut along said free long edge of the upper plate will be parallel to and abut the free edge of the already laid material under the lower plate.

2. A seaming tool according to claim 1 in which the hinge and plates are designed so the plates are substantially parallel when closed on material of the thickness for which the tool is designed.

3. A seaming tool according to claim 1 in which the free long edge of the upper plate is slightly closer to the hinge centerline than the stop means so the material between the plates which is cut along said free edge of the upper plate will, prior to laying, slightly overlap the already laid floor covering material under the lower plate so as to firmly abut the materials when laid.

4. A seaming tool according to claim 2 in which the free long edge of the upper plate is slightly closer to the hinge centerline than the stop means so the material between the plates which is cut along said free edge of the upper plate will, prior to laying, slightly overlap the already laid floor covering material under the lower plate so as to firmly abut the materials when laid.

* * * * *